US008611785B2

(12) United States Patent
Abe et al.

(10) Patent No.: US 8,611,785 B2
(45) Date of Patent: Dec. 17, 2013

(54) PROCESS CARTRIDGE INCLUDING A PLATE CONFIGURATION WITH INNER AND OUTER SIDE PLATES THAT ALLOW FOR ATTACHMENT TO AN IMAGE FORMING APPARATUS

(75) Inventors: Koji Abe, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 653 days.

(21) Appl. No.: 12/624,982

(22) Filed: Nov. 24, 2009

(65) Prior Publication Data

US 2010/0135692 A1 Jun. 3, 2010

(30) Foreign Application Priority Data

Nov. 28, 2008 (JP) ..... 2008-304938

(51) Int. Cl.
*G03G 21/16* (2006.01)

(52) U.S. Cl.
USPC ..... 399/111; 399/116; 399/117; 399/167

(58) Field of Classification Search
USPC ..... 399/111, 117
See application file for complete search history.

(56) References Cited

U.S. PATENT DOCUMENTS

| | | | | |
|---|---|---|---|---|
| 6,198,891 | B1 * | 3/2001 | Ishida et al. | 399/117 |
| 6,366,748 | B1 * | 4/2002 | Takeuchi et al. | 399/111 |
| 7,203,446 | B2 * | 4/2007 | Miura et al. | 399/116 |
| 7,890,013 | B2 * | 2/2011 | Okabe | 399/90 |
| 7,917,058 | B2 * | 3/2011 | Maehata et al. | 399/111 |
| 7,978,999 | B2 * | 7/2011 | Kamimura | 399/117 |
| 7,995,951 | B2 * | 8/2011 | Nieda | 399/167 |
| 8,290,397 | B2 * | 10/2012 | Kamimura | 399/111 |
| 2001/0021320 | A1 * | 9/2001 | Murayama et al. | 399/117 |
| 2005/0147432 | A1 * | 7/2005 | Miura et al. | 399/250 |
| 2007/0059038 | A1 * | 3/2007 | Shiraki | 399/119 |
| 2007/0071482 | A1 * | 3/2007 | Okabe | 399/90 |
| 2008/0159772 | A1 | 7/2008 | Koishi et al. | |
| 2008/0159775 | A1 * | 7/2008 | Koishi et al. | 399/90 |
| 2008/0260420 | A1 * | 10/2008 | Maehata et al. | 399/110 |
| 2009/0175653 | A1 * | 7/2009 | Kamimura | 399/117 |
| 2009/0220274 | A1 * | 9/2009 | Hashimoto | 399/113 |
| 2010/0028043 | A1 * | 2/2010 | Hashimoto et al. | 399/111 |
| 2010/0111562 | A1 * | 5/2010 | Okabe et al. | 399/112 |
| 2010/0135689 | A1 * | 6/2010 | Abe et al. | 399/90 |

(Continued)

FOREIGN PATENT DOCUMENTS

| | | |
|---|---|---|
| JP | 2007-024973 | 2/2007 |
| JP | 2008-165023 | 7/2008 |

*Primary Examiner* — Clayton E Laballe
*Assistant Examiner* — Geoffrey Evans
(74) *Attorney, Agent, or Firm* — Banner & Witcoff, Ltd.

(57) ABSTRACT

A process cartridge and an image forming apparatus are provided. The process cartridge is detachably mountable in an apparatus body of the image forming apparatus, and includes a plurality of photosensitive drums, a first outer side plate which is provided on one side of the photosensitive drums in an axial direction of the photosensitive drum, a second outer side plate which is provided on the other side of the photosensitive drums in the axial direction, and opposes the first outer side plate with the photosensitive drums interposed therebetween, and a plurality of input parts which are provided on ends of the photosensitive drums at the one side, respectively. An end face of each of the input parts being provided inward with respect to the outer surface of the first outer side plate.

14 Claims, 4 Drawing Sheets

4

(56) References Cited

U.S. PATENT DOCUMENTS

2011/0211865 A1* 9/2011 Hashimoto et al. ..... 399/119
2012/0121294 A1* 5/2012 Kamimura ..... 399/167
2012/0195633 A1* 8/2012 Okabe ..... 399/116
2012/0243905 A1* 9/2012 Uratani et al. ..... 399/111
2012/0308259 A1* 12/2012 Abe ..... 399/110
2012/0328328 A1* 12/2012 Okabe ..... 399/116

* cited by examiner

PROCESS CARTRIDGE INCLUDING A PLATE CONFIGURATION WITH INNER AND OUTER SIDE PLATES THAT ALLOW FOR ATTACHMENT TO AN IMAGE FORMING APPARATUS

CROSS-REFERENCE TO RELATED APPLICATION

This application claims priority from Japanese Patent Application No. 2008-304938, filed on Nov. 28, 2008, the entire subject matter of which is incorporated herein by reference.

TECHNICAL FIELD

Aspects of the present invention relate to a process cartridge and an image forming apparatus including the process cartridge.

BACKGROUND

An electrophotographic laser printer is configured such that a process cartridge including a photosensitive drum and a developing cartridge is detachably mounted in an apparatus body.

There has been proposed a process cartridge, a coupling member, to which a drive force for rotating a photosensitive drum is input, is provided at an end of a photosensitive drum which is rotatably held by a frame body.

In this process cartridge, the coupling member is provided so as to protrude outward from the frame body. When the process cartridge is mounted in an apparatus body of an image forming apparatus, a drive input shaft provided in the apparatus body is fitted to the coupling member. Accordingly, a drive force is transmitted to the coupling member, so that the photosensitive drum is rotated.

However, in this structure, the coupling member protrudes outward from the frame body. Accordingly, when the process cartridge is mounted in or detached from the apparatus body of the image forming apparatus, the coupling member could collide with other members provided in the apparatus body. Therefore, the process cartridge could not be smoothly mounted in the apparatus body. Further, if the coupling member repeatedly collides with other members provided in the apparatus body, there is a concern that the coupling member or other members provided in the apparatus body could be damaged.

SUMMARY

Accordingly, it is an aspect of the present invention to provide a process cartridge which can be smoothly mounted in or detached from an apparatus body and an image forming apparatus including the process cartridge.

According to an exemplary embodiment of the present invention, there is provided a process cartridge which is detachably mountable in an apparatus body of an image forming apparatus. The process cartridge comprises: a plurality of photosensitive drums; a first outer side plate which is provided on one side of the photosensitive drums in an axial direction of the photosensitive drum; a second outer side plate which is provided on the other side of the photosensitive drums in the axial direction, and opposes the first outer side plate with the photosensitive drums interposed therebetween; and a plurality of input parts which are provided on ends of the photosensitive drums at the one side, respectively, an end face of each of the input parts being provided inward with respect to the outer surface of the first outer side plate.

According to another exemplary embodiment of the present invention, there is provided an image forming apparatus comprising: an apparatus body; and the above-described process cartridge detachably mountable in the apparatus body.

According to a further exemplary embodiment of the present invention, there is provided a process cartridge which is detachably mountable in an apparatus body of an image forming apparatus. The process cartridge comprises: a photosensitive drum; a first outer side plate which is provided on one side of the photosensitive drum in an axial direction of the photosensitive drum; a second outer side plate which is provided on the other side of the photosensitive drum in the axial direction, and opposes the first outer side plate with the photosensitive drum interposed therebetween; and an input part which is provided on the end of the photosensitive drum at the one side to be non-rotatable in relation to each other, an end face of the input part being provided inward with respect to the outer surface of the first outer side plate.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

1. Printer

Figure 1:
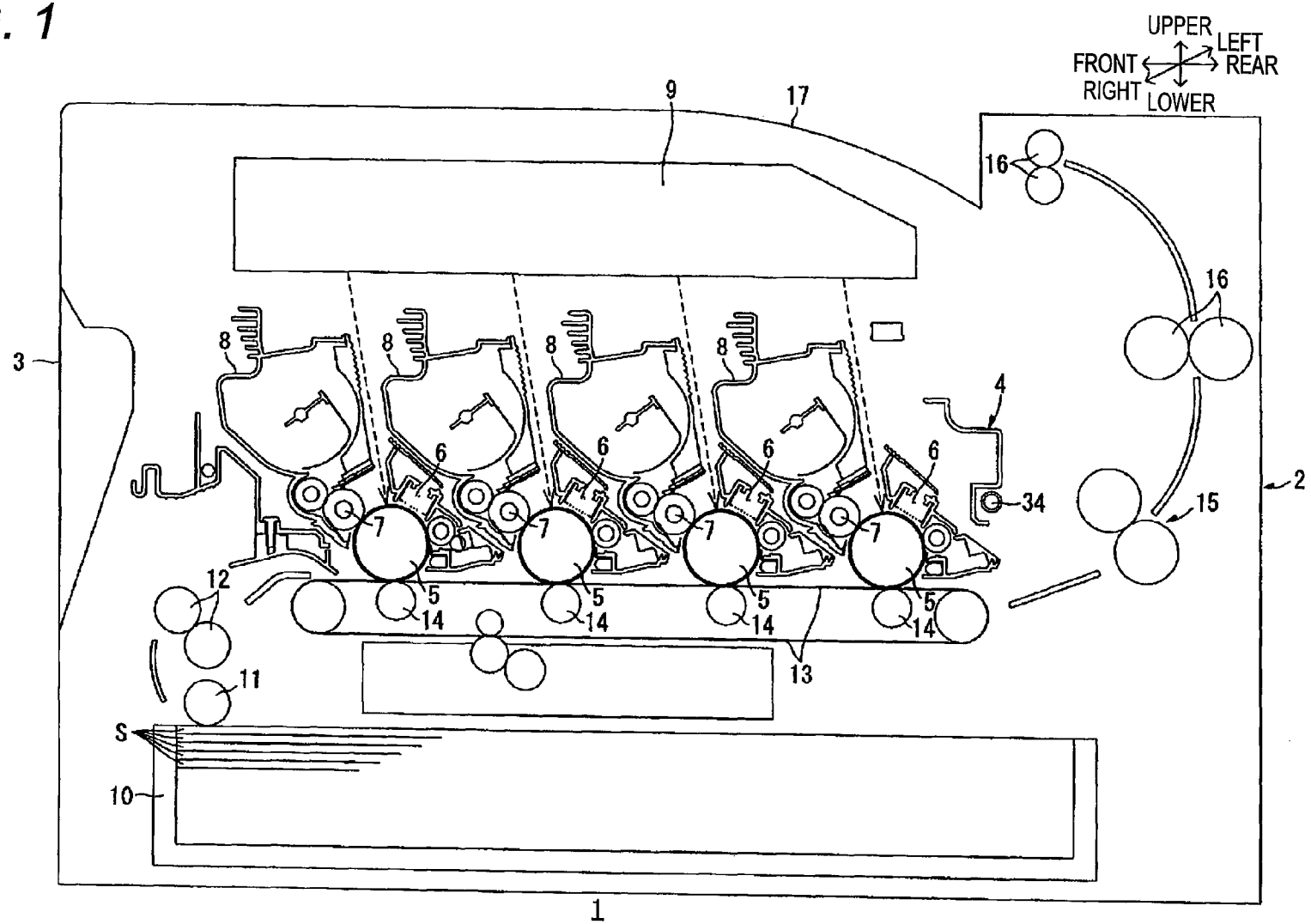
FIG. 1 is a side cross-sectional view of an embodiment of a printer as an example of an image forming apparatus according to the present invention.

Embodiments of the present invention will be described with reference to FIGS. 1 to 5. A printer 1 is shown in FIG. 1 as an example of an image forming apparatus according to an embodiment of the preset invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as the width direction, and the upper-lower direction is also referred to as the vertical direction. The left-right direction and the front-rear direction are also referred to as a horizontal direction. With regard to various individual components of the printer 1, sides of the individual components are similarly identified based on the arranged/attached position of the components on/in the printer 1.

The printer 1 is a tandem type color laser printer. The printer 1 includes a body casing 2 (an example of an apparatus body). A front cover 3 is provided on one side surface of the body casing 2 so as to be openable/closable.

A drum unit 4 (an example of a process cartridge) is provided in the body casing 2. While the front cover 3 is opened, the drum unit 4 is mounted in and removed from the body casing 2 through a mounting opening which is formed at the front surface of the body casing 2.

The drum unit 4 includes four photosensitive drums 5 which are provided in parallel with each other and arranged in a front-rear direction so as to be rotatable. A scorotron type charger 6 and a developing roller 7 are provided in each of the photosensitive drums 5 so as to oppose each other. Further, a developing cartridge 8, which holds the developing roller 7 and stores toner (developer), is provided adjacent to each of the photosensitive drums 5. The developing cartridge 8 is detachably mounted on the drum unit 4. Toner stored in developing cartridge 8 is carried on the surface of the developing roller 7.

After being uniformly charged with electricity by the chargers 6, the surfaces of the respective photosensitive drums 5 are exposed to laser beams (see arrows shown by a broken line in FIG. 1) which are emitted from a scanner unit 9 provided at an upper portion of the body casing 2. Accordingly, an electrostatic latent image based on image data is formed on the surface of each of the photosensitive drums 5. The electrostatic latent image of each of the photosensitive drums 5 is changed to a visible image by the toner which is carried on the surface of the developing roller 7 corresponding to each of the photosensitive drums 5. Accordingly, a toner image is formed on the surface of each of the photosensitive drums 5. Here, since the color of the toner stored in each of the developing cartridges 8 varies according to each of the developing cartridges 8, the color of the toner image of each of the photosensitive drums 5 varies according to each of the photosensitive drums 5.

Sheets S are stacked in a sheet feed cassette 10 in an upper-lower direction, which is provided at a bottom of the body casing 2. The uppermost sheet S of the sheets S stored in the sheet feed cassette 10 is fed forward by a sheet feed roller 11 which is provided at a front end of the sheet feed cassette 10 so as to oppose the sheet feed cassette from above. The fed sheet S is conveyed upwardly while the direction of the sheet S is changed from the front direction to the rear direction.

Then, sheet S enters between a pair of registration rollers 12. The pair of registration rollers 12 sends the sheet S to a conveyor belt 13, which is provided on the rear side, at a predetermined timing.

The conveyor belt 13 is an endless belt, and four transfer rollers 14 are provided inside the conveyor belt. The four transfer rollers 14 are provided in parallel in the front-rear direction, and each of the transfer rollers 14 opposes the corresponding photosensitive drum 5 from below with the upper portion of the conveyor belt 13 interposed therebetween.

The sheet S, which is sent from the pair of registration rollers 12, is conveyed onto the upper portion of the conveyor belt 13. The conveyor belt 13 is rotated in a clockwise direction in FIG. 1, so that the sheet S placed on the upper portion of the conveyor belt is conveyed to the rear side. The toner images, which are formed on the surfaces of the respective photosensitive drums 5, are transferred to the sheet S conveyed by the conveyor belt 13, by a transfer bias applied to the transfer rollers 14, and are sequentially superimposed. The color of the toner image of each of the photosensitive drums 5 varies according to each of the photosensitive drums 5. Therefore, toner images corresponding to four colors are superimposed on the sheet S, so that a color image is formed on the sheet S.

The sheet S on which a color image has been formed is conveyed to a fixing unit 15, which is provided on the rear side, by the conveyor belt 13. The toner images of the respective photosensitive drums 5, which have been transferred to the sheet S, are fixed by heat in the fixing unit 15. After that, the sheet S is conveyed by conveying rollers 16 upwardly while the direction of the sheet is changed from the rear direction to the front direction. Then, the sheet is discharged to a sheet discharge tray 17 which is provided at an upper portion of the body casing 2.

2. Drum Unit

Figure 2:
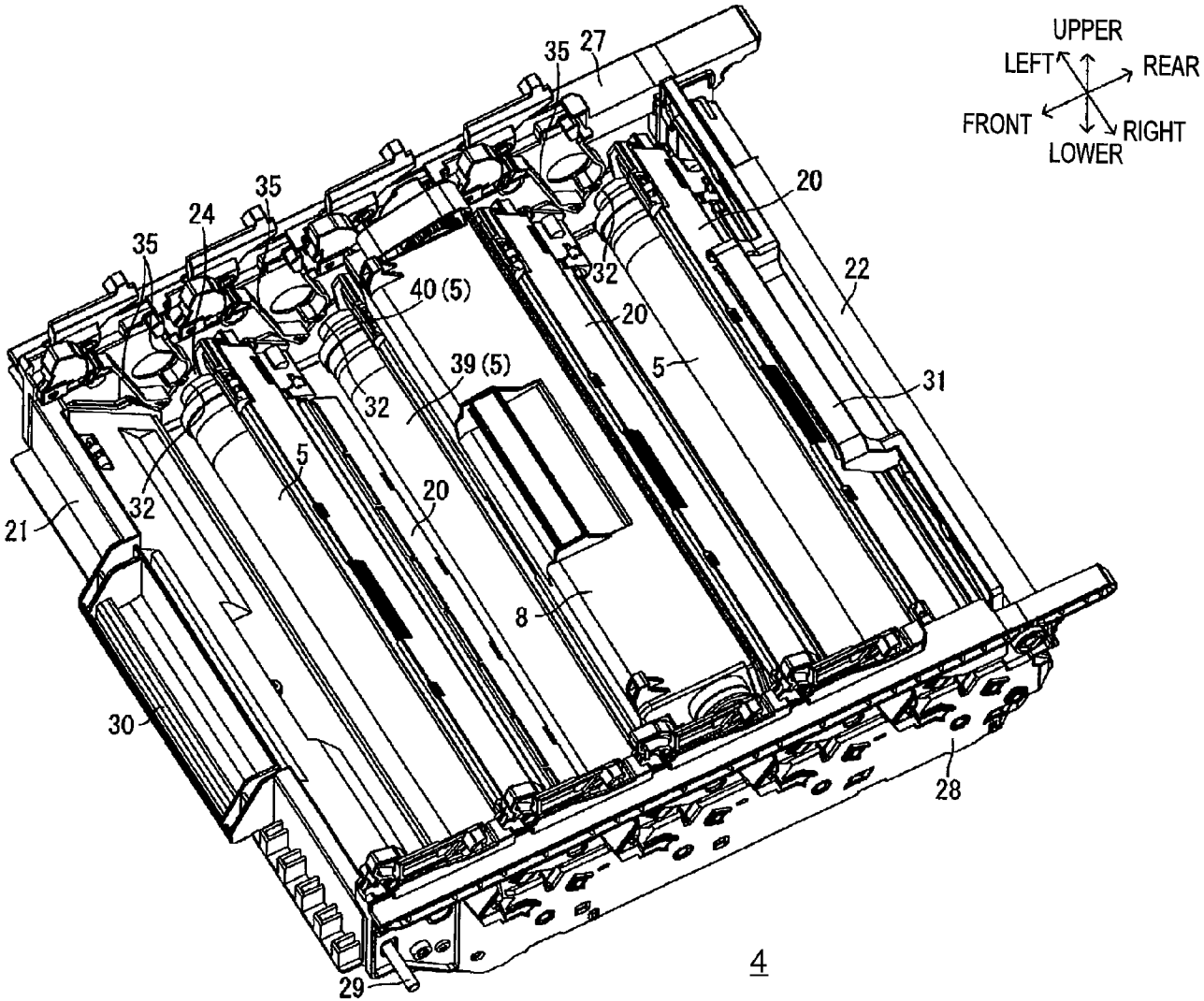
FIG. 2 is a perspective view of a drum unit as seen from a left front upper side, wherein one developing cartridge is mounted and other developing cartridges are separated.

As shown in FIG. 2, the drum unit 4 includes four photosensitive drums 5, four developing cartridges 8, four drum sub-units 20, a front beam 21, a rear beam 22, a pair of (first and second) inner side plates 24 and 25, and a pair of (first and second) outer side plates 27 and 28, as a unit. The drum unit is slidably mounted in or detached from the body casing 2 (see FIG. 1).

(1) Drum Sub-Unit

The four drum sub-units 20 are provided at an interval in the front-rear direction between the first and second inner side plates 24 and 25. Each of the drum sub-units 20 is made of resin, and is elongated in a width direction and has the shape of a substantially triangular prism which is opened at a front lower side thereof. The charger 6 shown in FIG. 1 and a cleaning member (not shown), which cleans the surface of the photosensitive drum 5, are held in each of the drum sub-units 20.

(2) Front Beam

The front beam 21 is made of resin. The front beam 21 is provided between the front ends of the pair of (first and second) inner side plates 24 and 25.

A supporting shaft 29 passes through the front beam 21 in a width direction of the front beam 21. The supporting shaft 29 protrudes outward from the front beam 21 in the width direction of the front beam. The supporting shaft passes through the pair of (first and second) inner side plates 24 and 25 and the pair of (first and second) outer side plates 27 and 28, and protrudes outward from the front beam in the width direction.

A front grip part 30 is formed integrally with the front beam in the middle of the front beam in the width direction on the front surface of the front beam 21. The front grip part 30 has a substantially U shape in plan view, and free ends of the front grip part are connected to the front beam 21.

(3) Rear Beam

The rear beam 22 is made of resin. The rear beam 22 is provided between the rear ends of the pair of (first and second) inner side plates 24 and 25.

A rear grip part 31 is formed integrally with the rear beam in the middle of the rear beam in the width direction on the upper surface of the rear beam 22. The rear grip part 31 has a substantially U shape in rear view, and free ends of the rear grip part are connected to the rear beam 22. The rear grip part is inclined from the rear lower side toward the front upper side, and is provided so as to protrude obliquely upward from the rear beam 22.

(4) Inner Side Plate

The first inner side plate 24 provided on the left side and the second inner side plate 25 provided on the right side are formed by the press working on a metal plate with using the same press die. Accordingly, the first and second inner side plates have the same shape.

Each of the first and second inner side plates 24 and 25 is formed in the shape of a substantially elongated rectangular plate which extends in the front-rear direction. The front and rear ends of the first inner side plate 24 oppose the front and rear beams 21 and 22 in the left-right direction, respectively. Similarly, the front and rear ends of the second inner side plate 25 oppose the front and rear beams 21 and 22 in the left-right direction, respectively.

Four circular drum supporting holes 32 are formed at each of the first and second inner side plates 24 and 25. The drum supporting holes 32 are formed between the front and rear ends of each of the first and second inner side plates 24 and 25 at a regular interval in the front-rear direction.

(5) Outer Side Plate

The pair of (first and second) outer side plates 27 and 28 is made of, for example, fiber reinforced resin. Each of the outer side plates 27 and 28 has the shape of a substantially elongated rectangular plate, which has a large width in the upper-lower direction and substantially the same length in the front-rear direction in comparison with the first and second inner side plates 24 and 25, in side view. The front and rear ends of each of the outer side plates 27 and 28 oppose the front and rear beams 21 and 22 in the left-right direction, respectively.

Figure 3:
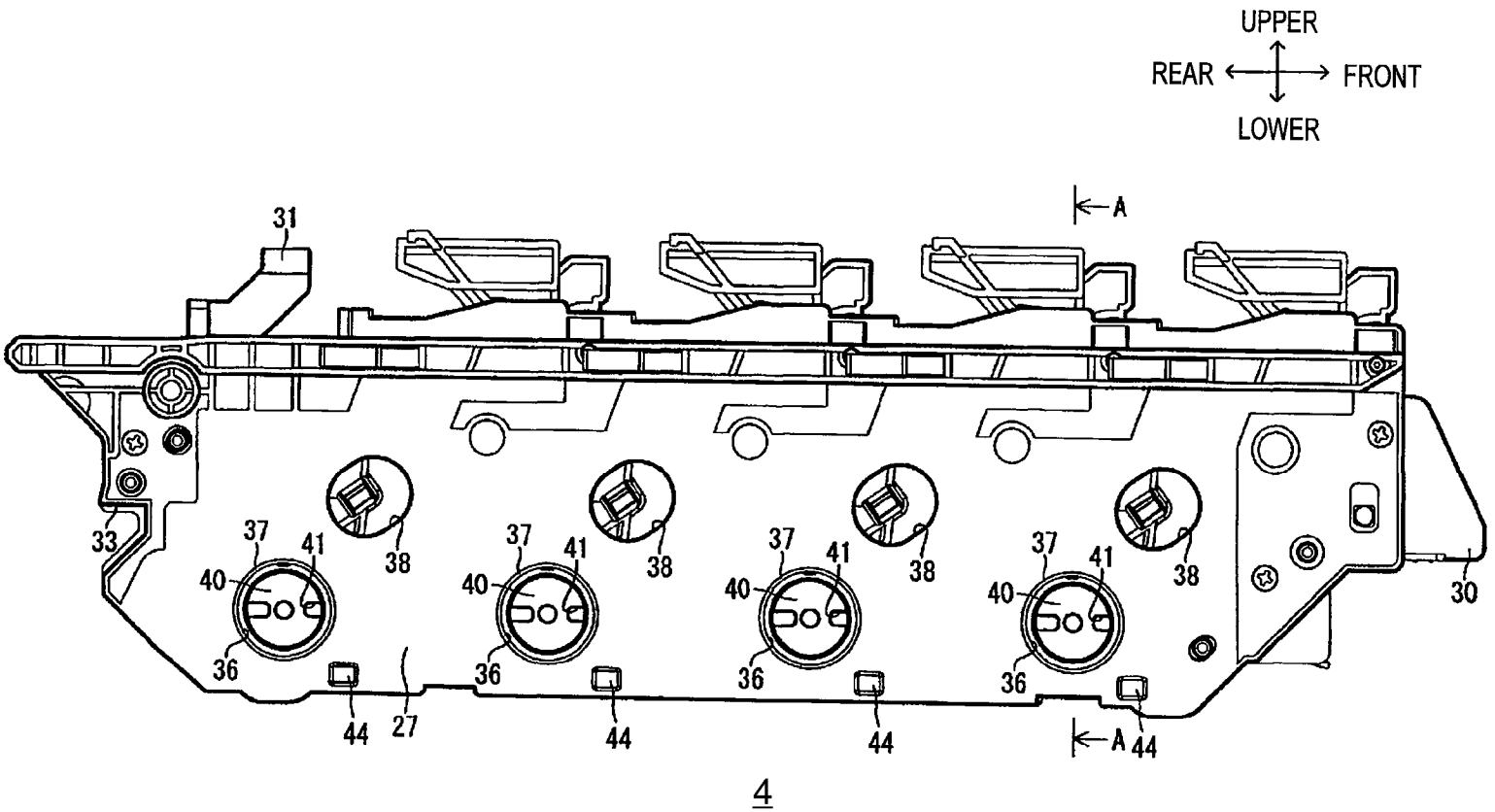
FIG. 3 is a left side view of the drum unit.
Figure 4:
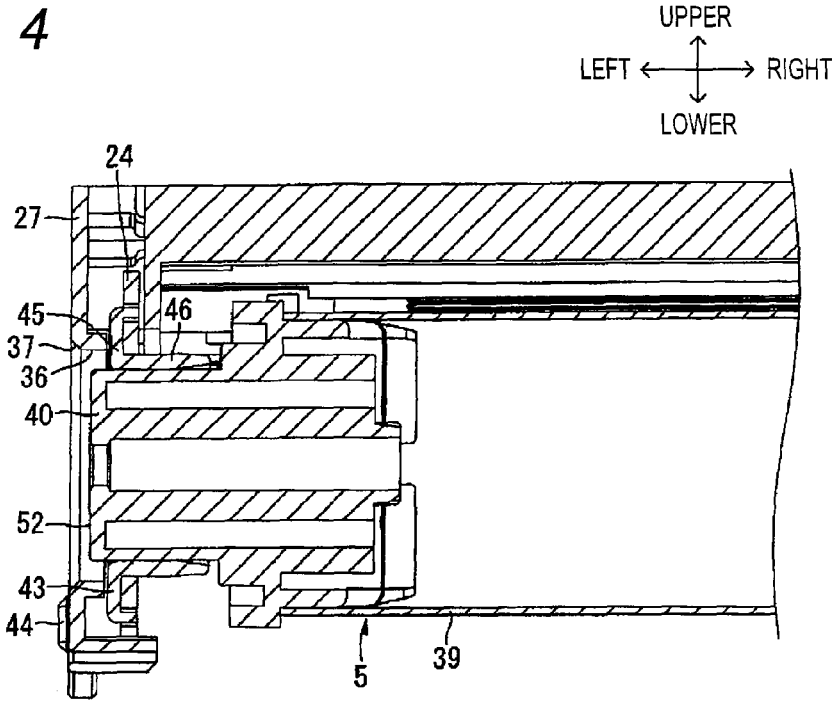
FIG. 4 is a cross-sectional view of a part of a process cartridge shown in FIG. 3, taken along a line A-A.
Figure 5:
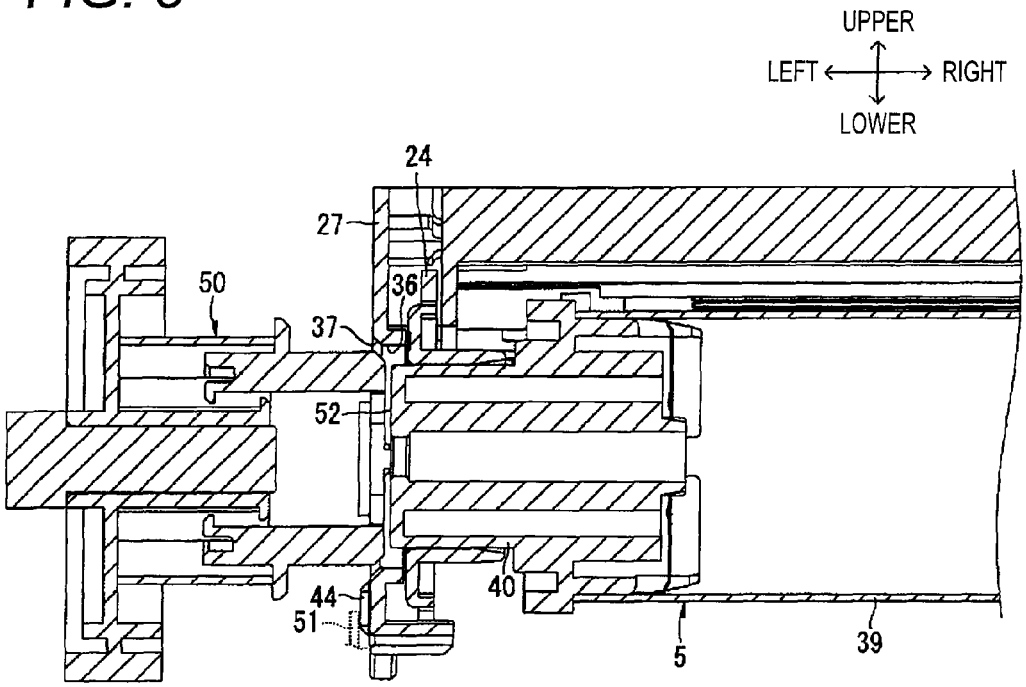
FIG. 5 is a cross-sectional view of a part of a process cartridge shown in FIG. 3, taken along a line A-A, wherein a drive transmission unit is connected to a fitting groove.

As shown in FIG. 3, the front ends of the outer side plates 27 and 28 are formed to be narrower than the middle portions of the outer side plates 27 and 28 in the upper-lower direction, and the lower end edges of the outer side plates 27 and 28 are inclined toward the front upper side.

The rear ends of the outer side plates 27 and 28 are formed to be narrower than the middle portions of the outer side plates 27 and 28 in the upper-lower direction, and the lower end edges of the outer side plates 27 and 28 are inclined toward the rear upper side.

Further, the outer side plates 27 and 28 are formed with cutout portions 33 at the rear ends thereof by cutting out the rear end edges of the outer side plates 27 and 28 in a substantially V shape. Specifically, each of the cutout portions 33 includes an upper end edge which extends in the front-rear direction, a lower end edge which is inclined toward the front upper side at a constant gradient with respect to the front upper side, and a front end edge which connects the front end of the upper end edge with the front end of the lower end edge. Further, cutout portions (not shown) are also formed at the rear ends of the first and second inner side plates 24 and 25 so as to overlap the cutout portions 33 of the outer side plates 27 and 28 when the drum unit 4 is assembled. Specifically, the cutout portions of the first and second inner side plates 24 and 25 have substantially the same shape as the cutout portions 33 of the outer side plates 27 and 28, and the front and lower end edges of the inner side plates are positioned on the rear side of the front and lower end edges of the cutout portions 33 of the outer side plates 27 and 28. When the drum unit 4 is mounted in the body casing 2, the cutout portions of the first and second inner side plates 24 and 25 receive a body reference shaft 34 (see FIG. 1) which is provided in the width direction at a rear portion of the body casing 2. The cutout portions come into contact with the body reference shaft 34 from the upper and front sides. Further, when the drum unit 4 is mounted in the body casing 2, the cutout portions 33 do not interfere with the body reference shaft 34.

As shown in FIG. 2, four cartridge guiding parts 35, which guide the developing cartridges 8 mounted or detached between the pair of outer side plates 27 and 28, are formed at an interval in the front-rear direction on the inner surfaces of the respective outer side plates 27 and 28. That is, the four cartridge guide parts 35 are formed on each of the right side surface of the first outer side plate 27 provided on the left side and the left side surface of the second outer side plate 28 provided on the right side. Each of the cartridge guiding parts 35 has two protrusions which protrude from the inner surface of the corresponding outer side plates 27 and 28 toward the inside in the width direction and are formed at an interval. The cartridge guiding parts 35 are inclined from the upper ends of the outer side plates 27 and 28 toward the rear lower side at a constant gradient, and the lower ends of the cartridge guiding parts are opened to the mounting positions of the photosensitive drums 5.

(5-1) First Outer Side Plate

As shown in FIG. 3, the first outer side plate 27 is formed with drum coupling insertion holes 36, through which the left ends of the respective photosensitive drums 5 in the axial direction of the photosensitive drum are exposed to the outside.

Specifically, four drum coupling insertion holes 36 are formed at the lower end portion of the first outer side plate 27 at an interval in the front-rear direction. Each of the drum coupling insertion holes 36 has a round shape and passes through the first outer side plate 27 in a thickness direction at positions opposing, in the width direction, the left end of the corresponding photosensitive drum 5 in the axial direction, and the corresponding drum supporting hole 32 (see FIG. 2) which is formed in the first inner side plate 24. A corner 37 between the inner surface of each drum coupling insertion hole 36 and the outer surface of the first outer side plate 27 is chamfered. In other words, the corner 37 has inclined surface connecting the drum coupling insertion hole 36 and the outer surface of the first outer side plate 27.

Further, the first outer side plate 27 is formed with development coupling insertion holes 38 at positions corresponding to the front upper side of the drum coupling insertion holes 36, so as to pass through the first outer side plate 27. When the respective developing cartridges 8 are mounted between the first and second outer side plate 27 and 28, passive coupling gears (not shown) provided at the left side surfaces of the developing cartridges 8 oppose the respective coupling insertion holes 38, respectively.

Further, the first outer side plate 27 is formed with protrusions 44 (an example of positioning part) at front lower positions of the drum coupling insertion holes 36, respectively. Each of the protrusion 44 protrudes from the outer surface of the first outer side plate 27 to the left side (to the outside in the width direction). The protrusion 44 has a shape of a flat quadrangular prism, the tip end of which is flat.

(6) Photosensitive Drum

As shown in FIG. 2, the photosensitive drum 5 includes a cylindrical drum body 39 and two flange members 40 which are fitted to both ends of the drum body 39 to be non-rotatable in relation to each other.

The outermost surface layer of the drum body 39 is formed of a photosensitive layer having a positive charging property.

The flange member 40 is made of resin material, and parts of the flange members are inserted into both ends of the drum body 39, respectively. A left end face 52 of the left flange member 40 (an example of an input part) is provided between the outer surface and the inner surface of the first outer side plate 27. Further, as shown in FIG. 3, the left end face 52 of each left flange member 40 is formed with a fitting groove 41, to which drive force is transmitted from a drive transmission unit 50 (described below) provided in the body casing 2.

The left and right flange members 40 are supported by bearing members 43 to be rotatable with respect to the inner side plates 24 and 25, respectively.

(7) Bearing Member

Each of the bearing members 43 is made of resin material, and includes a cylindrical part 46 and an annular disk-shaped flange part 45 which are integrally formed. The cylindrical part 46 has a cylindrical shape. The flange part 45 extends from the peripheral end edge of the cylindrical part 46 in the width direction, toward the outside (in a radial direction or in a direction orthogonal to the axis of the photosensitive drum 5).

The cylindrical part 46 has the outer diameter substantially same as the inner peripheral surface of each of the drum supporting holes 32 which are formed in the first and second inner side plates 24 and 25, and has the inner diameter substantially same as the outer peripheral surface of the flange member 40.

3. Mounting of Drum Unit in Body Casing

First, the front cover 3 of the body casing 2 is opened to mount the drum unit 4 in the body casing 2 as shown in FIG. 1. Further, the drum unit 4 is moved to the rear side, so that the drum unit 4 is guided into the body casing 2. After that, when the cutout portions of the inner side plates 24 and 25 (see FIG. 2) come into contact with the body reference shaft 34, further pushing of the drum unit 4 is regulated. Accordingly, the drum unit 4 is completely mounted in the body casing 2.

In this state, the protrusions 44, which are formed on the outer surface of the first outer side plate 27, come into contact with predetermined portions 51 (shown by a broken line in FIG. 5) provided in the body casing 2. With this configuration, the positioning of the drum unit 4 in the left-right direction is achieved.

(1) Transmission of Drive Force to Photosensitive Drum

The drive transmission units 50 are provided at positions which oppose the left sides of the respective drum coupling insertion holes 36 in a state where the drum unit 4 is mounted in the body casing 2. A driving source such as a motor is connected to each of the drive transmission units 50. In the state where the drum unit 4 is mounted in the body casing 2, the respective drive transmission units 50 protrude to the right side. Then, while being guided by the corners 37, the ends (right ends) of the drive transmission units 50 are inserted into the drum coupling insertion holes 36, respectively. Each of the drive transmission unit 50 includes a protrusion (not shown). The protrusion is connected to the fitting groove 41 shown in FIG. 3, so that the drive transmission unit 50 and the corresponding photosensitive drum 5 are connected to each other by the fitting groove 41. When the drive transmission unit 50 is rotationally driven, the drive force of the drive transmission unit is transmitted to the fitting groove 41. Accordingly, the photosensitive drum 5 is rotated through the fitting groove 41 (flange member 40).

4. Advantage

As described above, the first outer side plate 27 is provided on the left side of the photosensitive drums 5. Further, the second outer side plate 28 is provided on the right side of the photosensitive drums 5. The second outer side plate 28 opposes the first outer side plate 27 with the photosensitive drums 5 interposed therebetween. The flange member 40, to which a drive force for rotating the photosensitive drum 5 is input, is provided on the left end of the photosensitive drum 5. The left end face 52 of the flange member 40 is provided between the outer surface and the inner surface of the first outer side plate 27.

The drum unit 4 is mounted in or detached from the front side of the body casing 2 of the printer 1. Since the left end face 52 of the flange member 40 is provided between the outer surface and the inner surface of the first outer side plate 27, the left end face 52 does not protrude outward from the first outer side plate 27. In other words, the left end face 52 of the flange member 40 recedes inward from the outer surface of the first outer side plate 27. Since the left end face 52 of the flange member 40 recedes inward from the outer surface of the first outer side plate 27, the left end face 52 of the flange member 40 is protected by the first outer side plate 27. Therefore, when the drum unit 4 is mounted in or detached from the body casing 2, it is possible to reduce or prevent the left end face 52 of the flange member 40 from colliding with members provided in the body casing 2. As a result, it is possible to smoothly mount or detach the drum unit 4 in or from the body casing 2. Further, it is possible to reduce or prevent the damage to the flange member 40 which is caused by the collision between the left end face of the flange member and the members provided in the body casing.

Further, in comparison with the configuration in which the flange member 40 is formed so as to protrude outward (to the left side) from the first outer side plate 27, it is possible to move the first outer side plate 27 to the outside without changing the length of the photosensitive drum 5. Accordingly, it is possible to increase the volume of the developing cartridge 8 to be mounted between the first and second outer side plates 27 and 28. Therefore, it is possible to increase the amount of toner that is stored in the developing cartridge 8.

The first outer side plate 27 includes the protrusions 44 which are used to position the drum unit 4 in the body casing 2 in the width direction. The protrusions 44 protrude outward (to the left side) from the outer surface of the first outer side plate 27. Accordingly, when the drum unit 4 is mounted in the body casing 2, it is possible to secure a margin as much as the protruding distance of the protrusion 44 between the outer surface of the first outer side plate 27 and the predetermined portion 51 in the body casing 2. Therefore, it is possible to more reliably reduce or prevent the collision between the left end face 52 of the flange member 40 and the predetermined portion 51 provided in the body casing 2.

Further, the first and second inner side plates 24 and 25 are made of metallic material, and extend parallel to the inner surface of the first and second outer side plates 27 and 28, respectively. The drum supporting holes 32 are formed at positions, which oppose the photosensitive drums 5 in the width direction, on the first and second inner side plates 24 and 25. The bearing members 43 are fitted to the respective drum supporting holes 32, and hold the ends of the photosensitive drums 5 in the axial direction. Accordingly, both ends of the photosensitive drum 5 in the axial direction are held by the respective drum supporting holes 32 of the first and second inner side plates 24 and 25 through the bearing members 43.

Therefore, it is possible to provide both the ends of the photosensitive drum 5 between the first and second outer side plates 27 and 28 by adjusting a gap between the first and second outer side plates 27 and 28.

Further, the drum coupling insertion holes 36, which pass through the first outer side plate 27 in the width direction, are formed at the first outer side plate 27 at the positions which oppose the flange members 40 in the width direction. Therefore, it is possible to connect the drive transmission units 50, which are provided in the body casing 2 and transmit drive forces to the flange members 40, to the flange members 40 through the drum coupling insertion holes 36. Further, the corners 37 between the inner surfaces of the drum coupling insertion holes 36 and the outer surface of the first outer side plate 27, are chamfered. Therefore, even though the position of the drive transmission unit 50 is misaligned with the drum coupling insertion hole 36 to some extent, the right end of the drive transmission unit 50 comes into contact with the corner 37, so that it is possible to reliably lead the drive transmission unit 50 into the drum coupling insertion hole 36.

Further, the first and second outer side plates 27 and 28 extend in the front-rear direction. Furthermore, four photosensitive drums 5 are provided in parallel with each other and arranged in the front-rear direction. Accordingly, it is possible to collectively protect the flange members 40 which are provided at the left ends of the respective photosensitive drums 5.

Further, the printer 1 includes the drive transmission units 50 for transmitting drive forces to the left end faces 52 of the flange members 40. The left end faces 52 of the flange members 40 protrude outward from the first outer side plate 27. Accordingly, when the drum unit 4 is mounted in the body casing 2, the drive transmission units 50 protrude outward from the left end faces 52 of the flange members 40 in the axial direction. Therefore, it is possible to fit the drive transmission units 50 to the left end faces 52 (fitting grooves 41) of the flange members 40, and to transmit drive forces to the left end faces 52 of the flange members 40 from the drive transmission units 50.

5. Modification

While the present invention has been shown and described with reference to certain exemplary embodiments thereof, it will be understood by those skilled in the art that various changes in form and details may be made therein without departing from the spirit and scope of the invention as defined by the appended claims.

For example, in the above-described embodiment, four photosensitive drums 5 are collectively held by the drum unit 4. However, the present invention may be applied to a configuration in which four process cartridges are detachably mounted in the body casing 2 and one photosensitive drum is held between the first and second outer side plates in each process cartridge.

Further, in the above-described embodiment, a tandem type color laser printer is shown as an example. However, the present invention may be applied to a monochrome printer which includes single photosensitive drum.

Further, in the above-described embodiment, the left end face 52 of the left flange member 40 is provided between the outer surface and the inner surface of the first outer side plate 27. However, the present invention is not limited thereto. The left end face 52 of the left flange member 40 may be provided further inward. That is, the left end face 52 may be provided inside (the side of the photosensitive drum 5 or the side of the second outer side plate 28) of the inner surface of the first outer side plate 27.

In other words, the left end face 52 may be provided inward with respect to the outer surface of the first outer side plate 27. Herein, the term "inward" may include the situation that the left end face 52 is on the same face as the outer surface of the first outer side plate 27.

What is claimed is:

1. A process cartridge comprising:

a plurality of photosensitive drums;

a first outer side plate which is provided on one side of the photosensitive drums in an axial direction of the photosensitive drums;

a second outer side plate which is provided on another side of the photosensitive drums in the axial direction, and includes an inner surface which opposes an inner surface of the first outer side plate with the photosensitive drums interposed therebetween;

a first inner side plate which includes an outer surface extending in parallel to the first outer side plate and opposing the inner surface of the first outer side plate, and which includes drum supporting holes formed at positions opposing the photosensitive drums in the axial direction;

a second inner side plate which includes an outer surface extending in parallel to the second outer side plate and opposing the inner surface of the second outer side plate, and which includes drum supporting holes formed at positions opposing the photosensitive drums in the axial direction;

a plurality of bearing members which are fitted to the respective drum supporting holes and configured to hold the photosensitive drums at ends of the photosensitive drums in the axial direction; and a plurality of input parts which are provided on the ends of the photosensitive drums at the one side, respectively, an end face of each of the input parts being provided between an outer surface of the first outer side plate and the outer surface of the first inner side plate, wherein the process cartridge is configured to be drawable from an apparatus body of an image forming apparatus in a direction in parallel with an extending direction of the first outer side plate and the second outer side plate.

2. The process cartridge according to claim 1, wherein the end face of each of the input parts is provided between the outer surface and the inner surface of the first outer side plate.

3. The process cartridge according to claim 1, wherein each of the input parts is configured to input drive force for rotating the corresponding photosensitive drum.

4. The process cartridge according to claim 3, wherein each of the input parts is configured to be connected to a drive transmission unit provided in the image forming apparatus.

5. The process cartridge according to claim 1, wherein the first outer side plate includes a positioning part which protrudes outward from the outer surface of the first outer side plate, and positions the process cartridge with respect to the apparatus body in the axial direction.

6. The process cartridge according to claim 1, wherein the first and second inner side plates are made of metallic material.

7. The process cartridge according to claim 1, wherein the first outer side plate is formed with holes which pass through the first outer side plate in the axial direction, at positions opposing the input parts in the axial direction, and wherein a corner between an inner surface of each of the holes and the outer surface of the first outer side plate is chamfered.

8. The process cartridge according to claim 7, wherein the corner includes an inclined surface connecting the inner surface of the hole and the outer surface of the first outer side plate.

9. The process cartridge according to claim 1, wherein the first and second outer side plates extend in a direction orthogonal to the axial direction, and wherein the plurality of photosensitive drums are provided in parallel with each other and arranged in a direction in which the first and second outer side plates extend.

10. An image forming apparatus comprising:

an apparatus body; and a process cartridge configured to be detachably mounted in the apparatus body, the process cartridge comprising:

a plurality of photosensitive drums;

a first outer side plate which is provided on one side of the photosensitive drums in an axial direction of the photosensitive drums;

a second outer side plate which is provided on another side of the photosensitive drums in the axial direction, and includes an inner surface which opposes an inner surface of the first outer side plate with the photosensitive drums interposed therebetween;

a first inner side plate which includes an outer surface extending in parallel to the first outer side plate and opposing the inner surface of the first outer side plate, and which includes drum supporting holes formed at positions opposing the photosensitive drums in the axial direction;

a second inner side plate which includes an outer surface extending in parallel to the second outer side plate and opposing the inner surface of the second outer side plate, and which includes drum supporting holes formed at positions opposing the photosensitive drums in the axial direction;

a plurality of bearing members which are fitted to the respective drum supporting holes and configured to hold the photosensitive drums at ends of the photosensitive drums in the axial direction; and a plurality of input parts which are provided on the ends of the photosensitive drums at the one side, respectively, an end face of each of the input parts being provided between an outer surface of the first outer side plate and the outer surface of the first inner side plate, wherein the process cartridge is configured to be drawable from the apparatus body in a direction in parallel with an extending direction of the first outer side plate and the second outer side plate.

11. The image forming apparatus according to claim 10, wherein the end face of each of the input parts is provided between the outer surface and the inner surface of the first outer side plate.

12. The image forming apparatus according to claim 10, further comprising:

a plurality of drive transmission units which are fitted to the input parts, respectively, from the outside in the axial direction, and transmit drive force to the input parts when the process cartridge is mounted in the apparatus body.

13. A process cartridge comprising:

a photosensitive drum;

a first outer side plate which is provided on one side of the photosensitive drum in an axial direction of the photosensitive drum;

a second outer side plate which is provided on another side of the photosensitive drum in the axial direction, and includes an inner surface which opposes an inner surface of the first outer side plate with the photosensitive drum interposed therebetween;

a first inner side plate which includes an outer surface extending in parallel to the first outer side plate and opposing the inner surface of the first outer side plate, and which includes a drum supporting hole formed at a position opposing the photosensitive drum in the axial direction;

a second inner side plate which includes an outer surface extending in parallel to the second outer side plate and opposing the inner surface of the second outer side plate, and which includes a drum supporting hole formed at a position opposing the photosensitive drum in the axial direction;

a bearing which is fitted to the drum supporting hole and configured to hold the photosensitive drum at ends of the photosensitive drum in the axial direction; and an input part which is provided on the end of the photosensitive drum at the one side to be non-rotatable in relation to the photosensitive drum, an end face of the input part being provided between an outer surface of the first outer side plate and the outer surface of the first inner side plate, wherein the process cartridge is configured to be drawable from an apparatus body of an image forming apparatus in a direction in parallel with an extending direction of the first outer side plate and the second outer side plate.

14. The process cartridge according to claim 13, wherein the input part is formed with a groove on the end face at the one side, the groove being configured to fit with a protrusion of a drive transmission unit provided in the image forming apparatus.

* * * * *